US010111488B2

(12) United States Patent
Hauser

(10) Patent No.: US 10,111,488 B2
(45) Date of Patent: Oct. 30, 2018

(54) DISPOSABLE, LOW FRICTION, BREATHABLE BOOTIE FOR SKI BOOT

(71) Applicant: Frank G. Hauser, Bedford, NY (US)

(72) Inventor: Frank G. Hauser, Bedford, NY (US)

( * ) Notice: Subject to any disclaimer, the term of this patent is extended or adjusted under 35 U.S.C. 154(b) by 350 days.

(21) Appl. No.: 15/187,124

(22) Filed: Jun. 20, 2016

(65) Prior Publication Data

US 2017/0360145 A1 Dec. 21, 2017

(51) Int. Cl.

| | |
|---|---|
| ***A43B 11/00*** | (2006.01) |
| ***A43B 5/04*** | (2006.01) |
| ***A43B 3/00*** | (2006.01) |
| ***A43B 3/30*** | (2006.01) |
| ***A43B 7/08*** | (2006.01) |

(52) U.S. Cl.

CPC ..... *A43B 5/0405* (2013.01); *A43B 3/0078* (2013.01); *A43B 3/30* (2013.01); *A43B 5/0488* (2013.01); *A43B 7/085* (2013.01); *A43B 7/087* (2013.01); *A43B 7/088* (2013.01)

(58) Field of Classification Search

CPC ..... A43B 7/085; A43B 7/087; A43B 7/088; A43B 5/0405; A43B 5/0488

USPC ..... 36/10, 117.6, 138; 2/239; 223/113

See application file for complete search history.

(56) References Cited

U.S. PATENT DOCUMENTS 250,114 A * 11/1881 Waite ..... A43B 7/06 36/10
570,807 A * 11/1896 Jessen ..... D04B 1/26 2/239
1,805,035 A * 5/1931 Branley ..... D04B 1/26 2/239
3,417,408 A * 12/1968 Caggiano ..... A43B 3/24 2/239
3,895,452 A * 7/1975 Hanson ..... A43B 5/048 36/117.6
4,069,600 A * 1/1978 Wise ..... A43B 19/00 2/22
4,204,345 A * 5/1980 Bradley ..... A43B 5/0409 36/10
4,708,272 A * 11/1987 Guerra ..... A43B 11/00 2/239
5,615,418 A 4/1997 Pruit (Continued)

OTHER PUBLICATIONS

Ski & Snowboard Boot Horn—Helps Put Ski Boots on Easy—RBH-1, product description, available at http://www.ebay.com/itm/SKI-SNOWBOARD-BOOT-HORN-HELPS-PUT-SKI-BOOTS-ON-EASY-RBH-1-/290606441025, 2016.

(Continued)

*Primary Examiner* — Jila M Mohandesi

(74) *Attorney, Agent, or Firm* — Gordon & Jacobson, P.C.

(57) ABSTRACT

A disposable, low friction, breathable bootie is provided that accommodates the shape and size of a human foot. The bootie is made from a thin, flexible polymer sheet-like material in a generally tubular form. The bootie has a foot portion, a lower leg portion, and an ankle portion therebetween. The bootie includes a series of air vents in the foot portion and lower leg portion to provide airflow to the foot, while such vents are located to avoid key friction points between the foot and the ski boot during the donning and doffing processes. The bootie facilitates donning and doffing a ski boot. The vents provide breathability while the bootie is worn within the ski boot.

22 Claims, 1 Drawing Sheet

(56) References Cited

U.S. PATENT DOCUMENTS

| | | | | |
|---|---|---|---|---|
| 5,829,057 | A | 11/1998 | Gunn | |
| 6,665,883 | B2 * | 12/2003 | Sloan | A43B 3/106 2/239 |
| 7,699,195 | B2 * | 4/2010 | Scott | A47G 25/908 223/111 |
| 2008/0222772 | A1 | 9/2008 | Murray | |
| 2013/0000148 | A1 * | 1/2013 | Gellis | A41B 11/008 36/87 |
| 2013/0263360 | A1 * | 10/2013 | Thibodeau | A43B 7/14 2/239 |

OTHER PUBLICATIONS

Technique: Use a Boot Horn for Cold Boots, DOSTIE, Earn Your Turns, available at http://www.earnyourturns.com/17286/technique-use-a-boot-horn-for-cold-boots/, May 23, 2013.

* cited by examiner

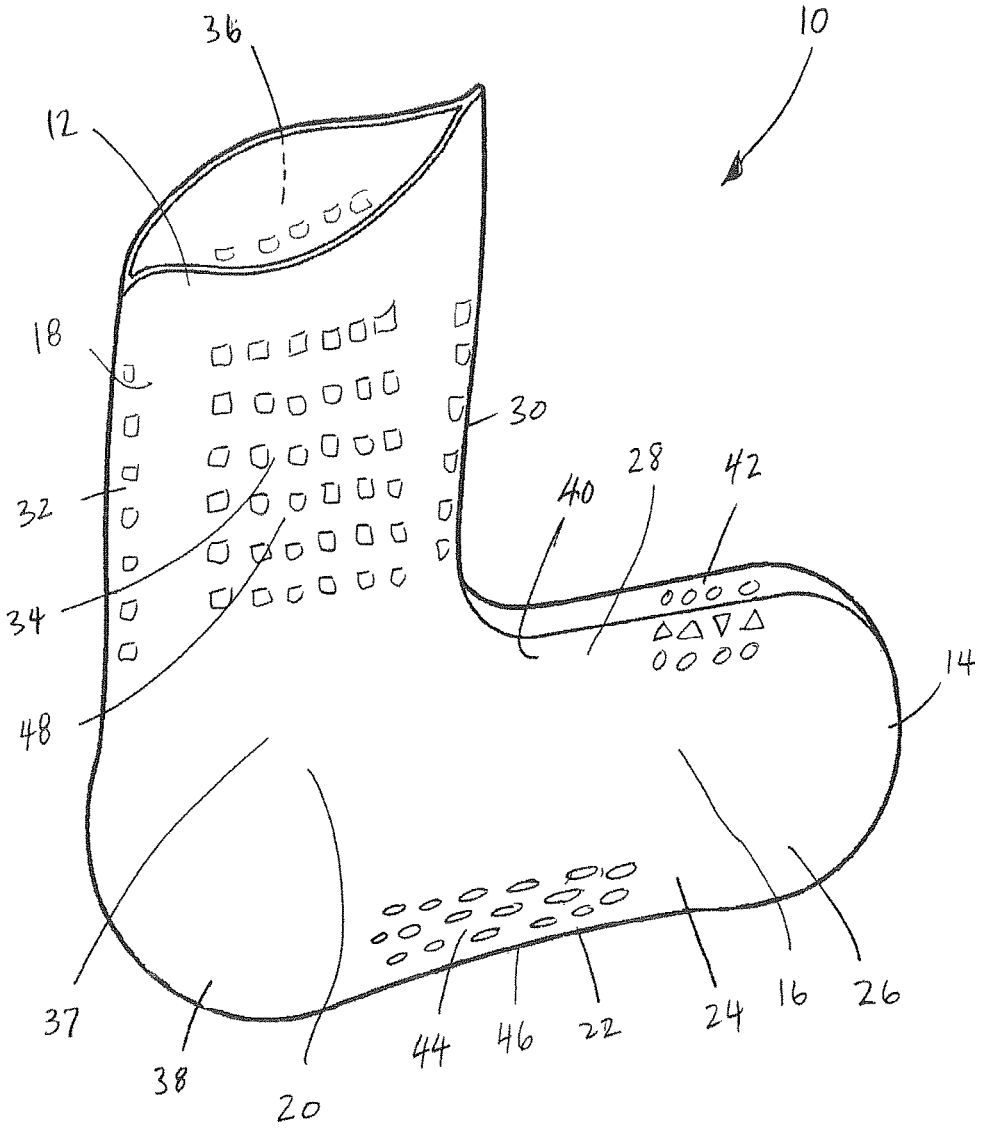
36
10
12
18
30
32
34
48
40
28
42
14
37
38
20
44
46
22
24
16
26

DISPOSABLE, LOW FRICTION, BREATHABLE BOOTIE FOR SKI BOOT

BACKGROUND OF THE INVENTION

1. Field of the Invention

The present invention relates to a device to facilitate donning and doffing a ski boot.

2. State of the Art

Donning ski boots is notoriously difficult. This is especially true when the boot is cold and has an overlapping tongue design. The plastic in the ski boot gets stiffer when colder, and if the boot is left in an unheated location overnight it is very difficult to open the tongue and position the foot fully into the boot. Further, as the foot is inserted into the boot, various locations on the foot and interior of the boot interfere with each other and impede insertion whether the boot has been stored in a heated or unheated location.

Moreover, after skiing, it is also difficult to doff a ski boot. The tight fit and friction between the foot and cold, stiff boot contribute to the difficulty in the removal.

One way in which this problem has been partially addressed is with a ski boot horn. A ski boot horn operates substantially the same as a standard shoe horn, but is larger in size and slightly different in shape to be better adapted to the size and shape of a ski boot. The ski boot horn provides a low friction surface between a limited portion of the interior of the boot and the back of the foot to aid in advancing the foot into the boot. However, the use of ski boot horn does not assist with interference at all key friction points during the donning process. Specifically, the ski boot horn does not reduce friction at the ball of the foot or on the top of the foot where the upper arch contacts the tongue of the ski boot while donning. Nor does the ski boot horn provide any assistance in difficulties that exist in doffing the boot after skiing. Also, the ski boot horn must be stored, retrieved for use and then returned to storage after use; thus, its use can be inconvenient and it is prone to being misplaced.

SUMMARY OF THE INVENTION

A disposable, low friction, breathable bootie is provided that accommodates the shape and size of a human foot. The bootie may be provided in various sizes adapted for the feet of both adults and children. The bootie is preferably made from a thin, flexible, low friction plastic sheet material in a generally tubular form. The bootie has a foot portion, a lower leg portion, and an ankle portion therebetween that preferably orients the foot portion at an angle relative to the lower leg portion. The foot portion includes an upper arch portion (instep), a lower arch portion, a ball portion, and a toe portion, corresponding to respective locations on a foot positioned within the bootie. The lower leg portion includes a front (anterior) side, a rear (posterior) side, and lateral and medial sides. The ankle portion includes an ankle joint portion and a lower heel portion. The bootie is preferably configured such that, when worn, a top edge of the leg portion and the top of the ski boot are similar in height; however the top edge of the leg portion may be slightly lower or slightly higher than the top of the ski boot.

According to one aspect of the bootie, the bootie includes a series of air vents to provide airflow to the foot, while such vents are located to avoid key friction points between the foot and the ski boot during the donning and doffing process. The vents prevent the bootie from acting as a vapor barrier which would have undesirable effects on the foot while in the ski boot (e.g., the promotion of sweating). In one configuration, the air vents are located (i) on the top of the foot portion of the bootie beginning just behind the toe portion and extending toward the lower leg portion to an area on the top of the foot portion just past where the ball of a foot placed in the bootie ends on the bottom of such foot, (ii) on the bottom of the foot portion at a location just past where the ball portion ends and the arch portion begins and then extending for the length of the arch portion to an area where the arch portion transitions into the heel portion, and/or (iii) on one or more of the front, rear, medial and lateral sides of the lower leg portion above the ankle portion and below the tope edge of the bootie. The vents do not significantly affect the integrity of the bootie for use after donning the ski boots and during skiing, such that their low friction outer surface may again be used to assist with doffing the ski boots from the foot after skiing.

The bootie, when worn on the foot, is adapted to have sufficient strength to maintain its integrity during donning a ski boot onto the foot, during a day of skiing, and subsequently when later doffing the boot from the foot.

In use, the bootie is placed on a preferably socked foot. Then the foot with bootie is positioned into a ski boot. The bootie facilitates insertion of the foot into the ski boot by reducing friction between the foot and ski boot, particularly at the ball of the foot, the arch on the top side of the foot and the heal (collectively the key friction points while donning or doffing a ski boot). The ski boot is then buckled while the bootie remains over the foot. Moreover, the vents allow heat, moisture and air to circulate from the foot through the sock and bootie and out. After skiing, because the bootie is still positioned over the socked foot, doffing the ski boot is greatly facilitated, as friction is reduced at aforementioned key friction points. The inexpensive materials and manufacture of the bootie permits a disposable, single-use product that can be discarded upon removal of the ski boots. The bootie may be particularly valuable to children who generally have a lower tolerance for discomfort and/or struggle while donning and doffing ski boots.

BRIEF DESCRIPTION OF THE DRAWING

The FIGURE is a perspective view of a representative bootie according to the invention.

DETAILED DESCRIPTION OF THE PREFERRED EMBODIMENTS

A disposable, low friction bootie 10 is provided that accommodates the shape and size of a human foot. The bootie 10 is preferably made in a common shape adapted for both left and right feet; however, it may be provided in left and right foot versions that respectively accommodate features of the left and right human feet. The bootie may be provided in various sizes adapted for the feet of both adults and children.

The bootie 10 is preferably made from a thin, flexible, low friction plastic sheet material in a generally tubular form with an open top end 12 and a closed distal end 14. The bootie 10 has a foot portion 16, a lower leg portion 18, and an ankle portion 20 therebetween that preferably orients the foot portion at an angle relative to the lower leg portion. The angle may be 70°-110°. As an alternative, the ankle portion 20 may be straight such that the bootie is in the general form of a tube sock. The foot portion 16 includes a lower arch portion 22, a ball portion 24, a distal toe portion 26, and an upper arch portion 28 (or an instep portion), all corresponding to respective portions of a human foot positioned within the bootie. The lower leg portion 18 includes a front (anterior) side 30, a rear (posterior) side 32, and medial and lateral sides 34, 36. The ankle portion 20 includes an ankle joint portion 37 and a lower heel portion 38. The bootie 10 is preferably configured such that, when worn, the top end 12 of the bootie and the top of the ski boot (not shown) are similar in height; however the lower leg portion 18 of the bootie may be sized to be slightly lower or slightly higher than the top of the ski boot.

Exemplar low friction, synthetic sheet materials for the manufacture of the bootie 10 include polymers. By way of example only, the sheet material can be made from any of the three basic types of polyethylene, including high-density polyethylene (HDPE), low-density polyethylene (LDPE), or linear low-density polyethylene (LLDPE). Similarly, other non-fabric-like synthetic materials can be used. Also, non-woven fabric-like synthetic material, such as sheet materials made of high-density polyethylene fibers that are spun and bonded together by heat and pressure, such as those sold under the brand Tyvec® from Dupont can also be used.

By way of example, for an adult sized bootie, the foot portion may be eight to twelve inches long and six inches wide; and the lower leg portion may be six to ten inches long, and six to eight inches wide (and opens to a diameter of six inches. The exact dimensions are not critical; provided that a user's foot can be comfortably fit within the bootie without tearing the bootie and without leaving so much extra material in the ski boot which could otherwise cause discomfort during skiing. A child's sized bootie is appropriately reduced in dimensions. Various intermediate size booties may also be provided to accommodate a range of shoe sizes.

According to one aspect of the bootie, the bootie 10 includes a series of air vents, with such vents located to avoid key friction points between the foot and the ski boot during the donning and doffing processes and/or where high strength of the booties is preferred, all where unbroken sheet material is preferred. Specifically, no vents are located at preferably each of the heal portion, the ball portion, and the upper arch portion, where the foot makes its most interfering contact with the inner posterior wall, inner sole and tongue, respectively, of the interior of the ski boot while donning, or at the toe portion where maximum material integrity is preferred. The vents provide breathability and prevent the bootie from acting as a vapor barrier. In one configuration, (i) a first set of air vents 42 is located on a top (superior side) 40 of the foot portion 16 of the bootie beginning just behind the toe portion 26 and extending toward the lower leg portion 18 to an area on the top of the foot portion just past where the ball portion 24 of the bootie ends on the bottom of such foot (and before the distal end of the upper arch portion 28—a key friction point—on the top of such foot), (ii) a second set of air vents 44 is provided on the bottom (inferior side) 46 of the foot portion at a location just past where the ball portion 24 proximally ends and the lower arch portion 22 begins and then extending posteriorly for the length of the lower arch portion 22 to an area where the lower arch portion 22 transitions into the heel portion 38, and (iii) a third (or more) set of air vents 48 is provided on one or more of the front, rear, medial and lateral sides 30, 32, 34, 36 of the lower leg portion 18 above the ankle portion 20 and below where the top end 12 of the bootie. The air vents 42, 44, 48 are located to retain the integrity of the bootie for use after donning the ski boots and during skiing, such that, after skiing, the low friction outer surface of the bootie may be used again to assist in doffing the ski boots.

The air vents 42, 44, 48 may be formed as circular, triangular, square and/or other shaped perforations. The air vents may be provided in a common size, or various sizes. The air vents may even be cut or stamped in the form of a design or even a logo. The air vents 42, 44, 48 are spaced-apart from one another to inhibit tearing of the sheet material as the bootie is placed on the foot, the ski boot is donned, the bootie is worn during skiing and/or while doffing the ski boot.

The bootie 10, when worn on the foot, is adapted to have sufficient strength to maintain its integrity during donning a ski boot, during a day of skiing, and subsequently when later doffing the boot.

In use, the bootie 10 is placed onto a socked foot. Then, the foot with bootie is inserted into a ski boot. The bootie 10 facilitates insertion of the foot into the ski boot by reducing friction between the foot and ski boot, particularly at the ball of the foot, the upper arch on the top side of the foot and the heal, which do not include air vents; it being noted that areas containing air vents may not have as low a reduction in friction as areas without air vents. The ski boot is then buckled while the bootie remains over the foot. Moreover, the air vents allow heat, moisture and air to circulate from the foot through the sock and bootie and out. After skiing, because the bootie is still positioned over the socked foot, when doffing the ski boot friction is reduced at key friction points and boot removal is greatly facilitated. The inexpensive materials and manufacture of the bootie permits a disposable, single-use product that can be discarded upon removal of the ski boots. The bootie is particularly helpful to children in donning and doffing ski boots.

There have been described and illustrated herein embodiments of a bootie for use between a human foot and a ski boot, and a method of donning and doffing ski boots with the use of a bootie as described herein. While particular embodiments of the invention have been described, it is not intended that the invention be limited thereto, as it is intended that the invention be as broad in scope as the art will allow and that the specification be read likewise. Thus, while particular materials and dimensions have been disclosed, it will be appreciated that other materials and dimensions can be used as well. In addition, while the booties have been described with particular advantage in relation to donning and doffing ski boots, it is appreciated that the booties may be used to don and doff other types of footwear, and this disclosure is intended to cover such uses as well. It will therefore be appreciated by those skilled in the art that yet other modifications could be made to the provided invention without deviating from the scope as claimed.

What is claimed is:

1. A bootie to be worn by a human foot to facilitate donning and doffing ski boots, comprising:

a thin, flexible, low friction plastic sheet material in a generally tubular form having an open upper end, a closed lower end, an interior and an exterior, the tubular form sized to receive the human foot between the upper end and the lower end, the tubular form having a foot portion, a lower leg portion, and an ankle portion therebetween, the foot portion having an upper arch portion, a lower arch portion, a ball portion, and a distal toe portion, corresponding to respective portions of the human foot when positioned within the bootie, the lower leg portion having a front side, a rear side, and lateral and medial sides, a top edge, and the ankle portion having an ankle portion and a lower heel portion, the sheet material including at least one set of air vents to provide breathability between the exterior of the tubular form and the human foot at the interior of the tubular form, the at least one set of air vents selected from:

(i) a first set of air vents located on a top side of the foot portion of the bootie beginning behind the toe portion and extending toward the lower leg portion to an area on the top side of the foot portion just past where the ball of the foot portion of the bootie ends, (ii) a second set of air vents located on the bottom side of the foot portion at a location past where the ball portion proximally ends and the arch portion begins and then extending for the length of the arch portion to an area where the arch portion transitions into the heel portion, and (iii) at least a third set of air vents located on one or more of the front, rear, medial and lateral sides of the lower leg portion above the ankle portion and below the top edge.

2. The bootie according to claim 1, wherein:

the at least one set of air vents is absent from a set of friction points located between the human foot and the ski boot while donning and doffing the ski boot.

3. The bootie according to claim 1, wherein:

the at least one set of air vents is absent from the ball portion and the upper arch portion.

4. The bootie according to claim 1, wherein:

the at least one set of air vents is absent from the toe portion.

5. The bootie according to claim 1, wherein:

the at least one set of air vents are provided within the sheet material in a manner and location to retain the integrity of the bootie for use after donning the ski boots and during skiing, such that the low friction exterior of the sheet material surface is adapted to assist in doffing the ski boot from the foot after skiing.

6. The bootie according to claim 1, wherein:

the air vents include at least two of the first, second and third sets of air vents.

7. The bootie according to claim 1, wherein:

the air vents include all of the first, second and third set of air vents.

8. The bootie according to claim 1, wherein:

the air vents include the at least the third set of air vents, and the air vents are located on at least two of the front, rear, medial and lateral sides of the lower leg portion.

9. The bootie according to claim 1, wherein:

the air vents include the at least the third set of air vents, and the air vents are located on at least three of the front, rear, medial and lateral sides of the lower leg portion.

10. The bootie according to claim 1, wherein:

the air vents include the at least the third set of air vents, and the air vents are located on all four of the front, rear, medial and lateral sides of the lower leg portion.

11. The bootie according to claim 1, wherein:

the air vents are circular, triangular, slit and/or square in shape.

12. The bootie according to claim 1, wherein:

the air vents are rounded or polygonal in shape.

13. The bootie according to claim 1, wherein:

the air vents are provided in a plurality of sizes and/or shapes.

14. The bootie according to claim 1, wherein:

the foot portion and the lower leg portion are angled at 70°-110° relative to each other.

15. The bootie according to claim 1, wherein:

the bootie is in a form of a straight tube.

16. The bootie according to claim 1, wherein:

the sheet material is made from polyethylene.

17. The bootie according to claim 1, wherein:

the sheet material is a made from a nonwoven fabric-like synthetic material.

18. The bootie according to claim 1, wherein:

the foot portion is eight to twelve inches long and six inches wide, and the lower leg portion is six to ten inches long, and six to eight inches wide.

19. A method of donning and doffing a ski boot, comprising:

a) providing a foot;

b) placing a thin, flexible, breathable low friction plastic sheet material bootie onto the foot;

c) next, placing the foot with bootie into a ski boot, wherein the bootie reduces friction between the foot and the ski boot to facilitate insertion of the foot into the ski boot;

d) securing the ski boot onto the foot while the bootie remains on the foot; and e) after, doffing the ski boot from the foot, wherein the bootie reduces friction between the foot and the ski boot to facilitate removal of the foot from the ski boot.

20. The method according to claim 19, further comprising:

after securing and before doffing, skiing in the ski boot while the bootie is provided on the foot.

21. The method according to claim 19, wherein:

the bootie has a plurality of air vents in the sheet material.

22. The method according to claim 21, wherein:

the bootie has no air vents at a ball portion, an upper arch portion, and a heel portion of the bootie.

* * * * *